United States Patent [19]

Schultz

[11] 4,079,383

[45] Mar. 14, 1978

[54] POINTING ERROR COMPENSATING DEVICE

[75] Inventor: Roger Thomas Schultz, Los Altos, Calif.

[73] Assignee: Ford Aerospace & Communications Corporation, Dearborn, Mich.

[21] Appl. No.: 712,999

[22] Filed: Aug. 9, 1976

[51] Int. Cl.[2] ..... H01Q 1/10; H01Q 3/02

[52] U.S. Cl. ..... 343/760; 343/894

[58] Field of Search ..... 343/760, 894, 765; 33/1 PT; 73/209, DIG. 5, 432 A

[56] References Cited

U.S. PATENT DOCUMENTS

| | | | |
|---|---|---|---|
| 2,407,275 | 9/1946 | Hays, Jr. | 343/760 |
| 2,408,825 | 10/1946 | Varian et al. | 343/765 |
| 3,153,789 | 10/1964 | Ashton | 343/894 |
| 3,239,839 | 3/1966 | Banche et al. | 343/765 |
| 3,893,123 | 7/1975 | Bieser | 343/760 |
| 3,977,248 | 8/1976 | Metzger | 73/432 A |

*Primary Examiner*—Alfred E. Smith
*Assistant Examiner*—David K. Moore
*Attorney, Agent, or Firm*—John J. Roethel; Keith L. Zerschling

[57] ABSTRACT

A pointing error compensating device for compensating the error induced in a position indicator as a result of forces acting on a structure, such as gravitational forces acting on a large antenna having a reflecting dish, that is pivotal about an elevation axis.

The error compensating device comprises a torque producing device having a moment arm in the form of an eccentric mass attached to a shaft coupled to the structure, the shaft being rotatable in response to a pivotal movement of the structure. The shaft is also coupled to a drive shaft of the position indicator. The eccentric mass is attached to the transmission shaft in such a manner that it applies a torque to the latter which is proportional to the cosine of the angular orientation of the structure about the elevation axis. The transmission shaft is deflected torsionally by the eccentric mass in an amount which is designed to be approximately equal and opposite to the error which otherwise would be induced into the position indicator.

16 Claims, 4 Drawing Figures

POINTING ERROR COMPENSATING DEVICE

BACKGROUND OF THE INVENTION

It is desirable that the beam pointing direction of large steerable microwave antennas be known accurately. A measure of this accuracy is known in the art as "pointing error," and is defined as the angular difference between the total angle pointing direction indicated by antenna instrumentation and the direction toward the actual maxima of the radio source being tracked.

As a practical matter, the position indicator, which generally takes the form of an angle transducer, which senses angular pointing of the antenna must be connected physically to the structure of the antenna through mechanisms which are not exactly indicative of the true pointing vector due to distortions of the entire structure. Some error causing distortions such as those caused by wind loads and thermal gradients are classed as "random;" others are "systematic" because they can be predicted as a function of known operating parameters.

For all antenna axis which rotate about a nonvertical axis (e.g., elevation axis of common Az/El systems) gravity is in a changing relation to the structure as axis rotation takes place. Each structural element distorts with respect to other elements according to mass and stiffness characteristics. The antenna microwave optics distort causing the vector representing the maximum signal received to distort with respct to all structural elements and in particular to the drive shaft of the position indicator or transducer used to indicate antenna pointing.

The classical solution to this problem has been to make the structure stiff enough to reduce the overall deflection to a magnitude small with respect to the allowable pointing error. The costs associated with this approach are high since the analysis to determine the deflection characteristics of candidate antenna structures is tedious and since the required stiff structure is very heavy, thus expensive.

Another method has been explored to reduce pointing error when the structural design was not governed by gravity deflection. The system was calibrated to establish the relation between pointing error and indicated elevation pointing angle so that a correction to the position signal generated by the transducer could be made to its output according to the uncorrected output. The computer equipment to accomplish this function was costly and contributed to the unreliability and complexity of the system.

Prior art patents representative of methods of preventing deflections in the antenna structure to reduce pointing error include:

U.S. Pat. No. 3,239,839 issued to J. Banche et al on Mar. 8, 1966, for "Antenna Reflector Surface Contour Control." Banche et al shows a method of compensation with levers whose moment arms change with the orientation of the antenna and which apply forces to the dish so as to compensate for the distortion of the dish due to antenna orientation.

U.S. Pat. No. 3,153,789 issued to E. L. Ashton on Oct. 20, 1964, for "Large Aperture Steerable Trunnion - Mounted Paraboloidal Antenna." Ashton shows a large antenna where distortions due to gravitational and/or wind stresses are compensated by pre-distorting certain struts so that their lengths either do not change or the lengths compensate for the defocusing of the antenna due to stresses. A position indicator is shown in FIGS. 36 through 40 and described in column 13 and 14.

U.S. Pat. No. 2,408,825 issued Oct. 8, 1946, to R. H. Varian et al for "Object Detecting and Locating Device." Varian et al shows the use of torque arms to reduce vibration in scanning dish antennas.

SUMMARY OF THE INVENTION

The present invention relates to a compensating device for compensating the error induced in a position indicator as a result of forces acting on a structure that is pivotable about an elevation axis. The error compensating device comprises a torque producing means having a moment arm in the form of an eccentric mass attached to a transfer shaft. The transfer shaft is interposed between the structure and a drive shaft of the position indicator and rotates in response to pivotal movement of the structure to drive the position indicator to indicate the angle of elevation of the structure. The eccentric mass is constructed and arranged so that it applies a torque to the transfer shaft that is a sinusoidal function of the angular orientation of the structure above its elevation axis. The transfer shaft is deflected torsionally by the eccentric mass in an amount which approximately is equal and opposite to the error which otherwise would be transferred to the drive shaft of the position indicator.

DESCRIPTION OF THE DRAWINGS

Further advantages and features of the present invention will be made more apparent as this description proceeds, reference being made to the accompanying drawings; wherein.

DETAILED DESCRIPTION OF THE INVENTION

Figure 1:
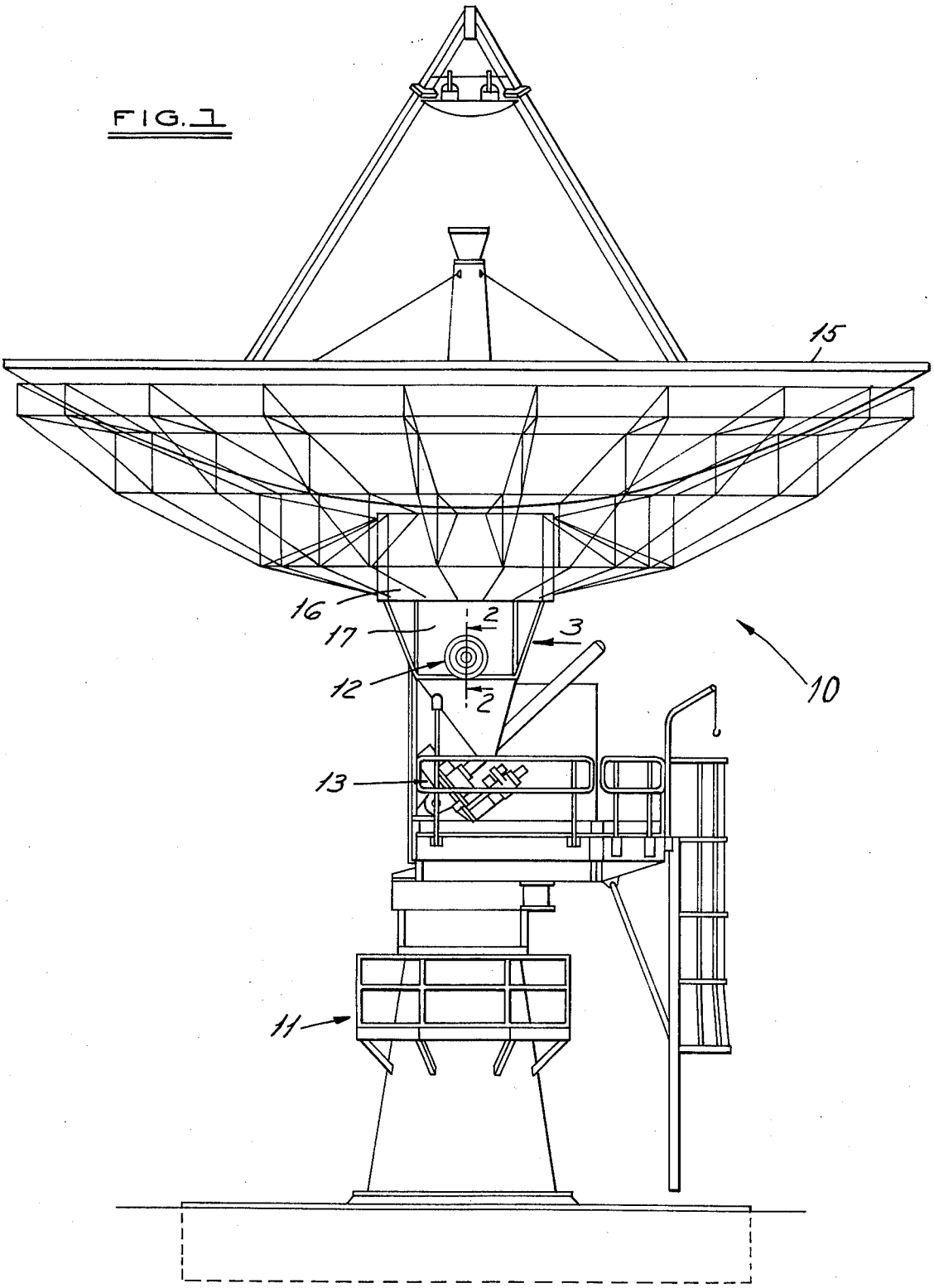
FIG. 1 is a side elevational view of an antenna which includes a reflecting dish and which includes an embodiment of the pointing error compensating device of the present invention.

Referring now to the drawings, FIG. 1 illustrates a large tracking antenna, generally designated 10, which is supported on a base structure 11. The base structure 11 may include or be mounted on a turntable to provide a vertical axis about which the antenna is rotatable for azimuth positioning or adjustment. Near its upper end, the base structure 11 includes devices 12 which support the antenna for tilting movement about a horizontal or elevation axis.

The antenna 10 is shown as coupled to an antenna elevation drive mechanism 13 comprising a ball-screw actuator that is operable to rotate or tilt the antenna about its elevation axis. The specifics of the antenna elevation drive mechanism are not important to the present invention, reference being made to the elevation drive mechanism to show that some device is provided to position the antenna at selected elevation angles which are indicated by a position indicator. The position indicator is generally in the form of an encoder or angle transducer and is indicated at 14 in FIG. 2.

The antenna 10 illustrated is a large structure having a reflecting dish 15 which may be any size in diameter and which may weight as much as 250,000 pounds.

Analysis and empirical data show that the mathematical relation of the "pointing error" of such an antenna to actual elevation angle are not exactly simple relations. If a Fourier representation of the required correction is evaluated, it is frequently found that the bulk of the correction is made by the first harmonic. Typically no correction is needed at zenith pointing. As the reflector rotates downward, the reflector extremities rotate further than the axis shaft where the angle transducer is usually attached, such that the "beam" rotates more than the shaft. The error increases approximately as the cosine of the elevation angle (horizon = 0°, zenith = 90°).

The pointing error compensating device herein disclosed imposes a first harmonic correction by mechanical means interposed between the bulk of the antenna structure and the position indicator or angle transducer.

The base 16 of the antenna reflector dish structure 15 is supported on spaced yoke arms 17. The yoke arms are journalled on non-rotatable supports or trunnions 18 (see FIG. 3). Suitable bearing devices 19 (see FIG. 2) are interposed between the yoke arms 17 and the trunnions 18. The trunnions 18, bearing devices 19 and coacting forces of the yoke arm 17 comprise the pivot mechanism which was generally designated 12 (see FIG. 1).

Figure 2:
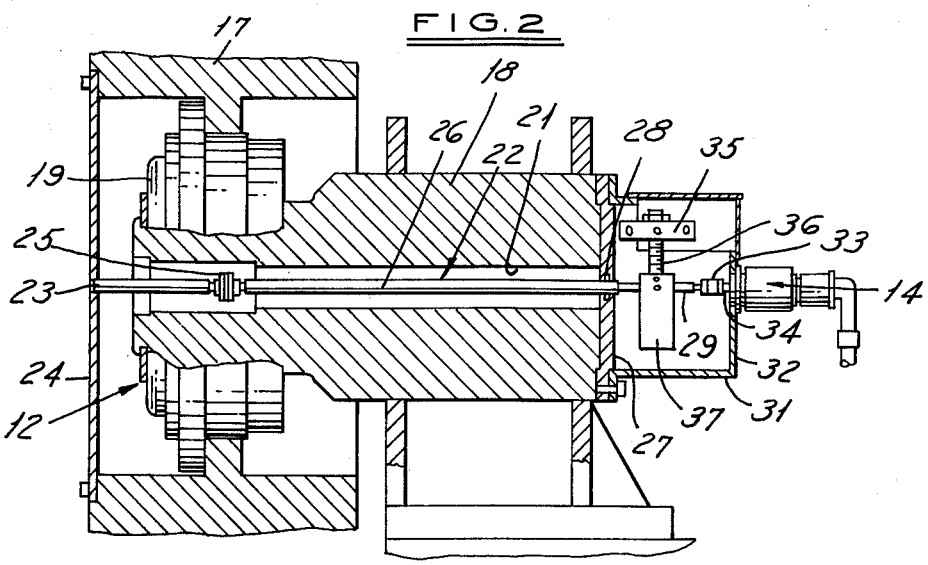
FIG. 2 is an enlarged fragmentary sectional view on the line 2–2 of FIG. 1.
Figure 3:
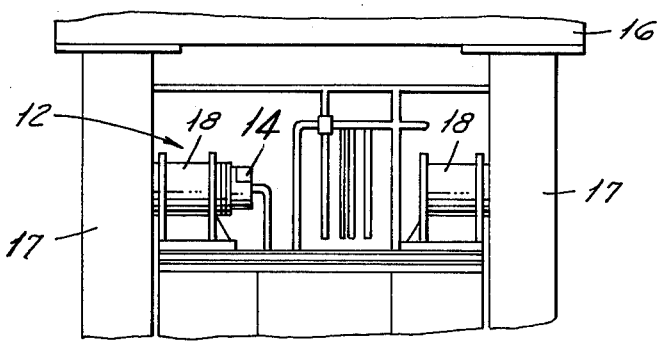
FIG. 3 is an enlarged view taken in the direction of the arrow 3 in FIG. 1.

The trunnion 18 supporting the left yoke arm, as viewed in FIG. 3, has a longitudinally extending bore 21 extending there through, as best seen in FIG. 2. A segmented shaft, generally designated 22, which may also hereinafter be referred to as a transfer shaft extends through the bore 21. The left end segment 23 of the shaft 22 is welded or otherwise nonrotatably secured to a plate 24 bolted to yoke arm 17. The segment 23 is coupled by a coupling 25 to a longer segment 26 which extends through a bearing housing 27 bolted to the right end of trunnion 18. The bearing housing 27 contains a suitable bearing device 28 in which the longer shaft segment 26 is free to rotate. The shaft segment 26 has a rigid longitudinally extension 29 which extends into a housing 31. An end wall 32 of the housing externally supports the position indicator 14. The position indicator is illustrated as connected by suitable conduit to remote instrumentation of the antenna but is referred to herein for convenience as though it was a direct reading device available at the location shown. The extension 29 of the segment 26 of shaft 22 is coupled by a coupling 33 to the drive shaft 34 of the position indicator.

The segmented transfer shaft 22 lies on the elevation axis of the antenna and transmits the pivotal or tilting movement of the antenna yoke arm 17 to the position indicator 14. As has been discussed, the angle indicated by the position indicator is not without error. As the reflector rotates downward, the reflector extremities rotate further than the axis shaft to which the position indicator or angle transducer is usually attached, as shown.

The error compensating device embodying the present invention comprises the transfer shaft 22, which is a shaft of proper torisonal stiffness, and an eccentric mass attached to the shaft. As shown in FIG. 2, the eccentric mass comprises a weight 35 carried on a threaded arm 36 extending at a right angle to the extension 29 of the segment 26 of the shaft 22.

The threaded arm 36 is a radial extension of a counterweight 37 which is non-rotatably coupled to the shaft extension 26. The weight or mass 35, the threaded arm 36 and counterweight 37 are contained within the housing 31.

The counterweight 37 is not intended to counterbalance the weight of the eccentric weight 35 since it is intended that the latter torsionally deflect the shaft 22 in a direction equal and opposite to the error induced in the position indicator as a result of the gravitational forces causing antenna structure deflection. The use of the counterweight 37 allows a larger weight 35 to be used to permit greater sensitivity in calibrating the device. The device is calibrated by the weight 35 being radially adjusted on the threaded arm relative to the elevation axis.

Figure 4:
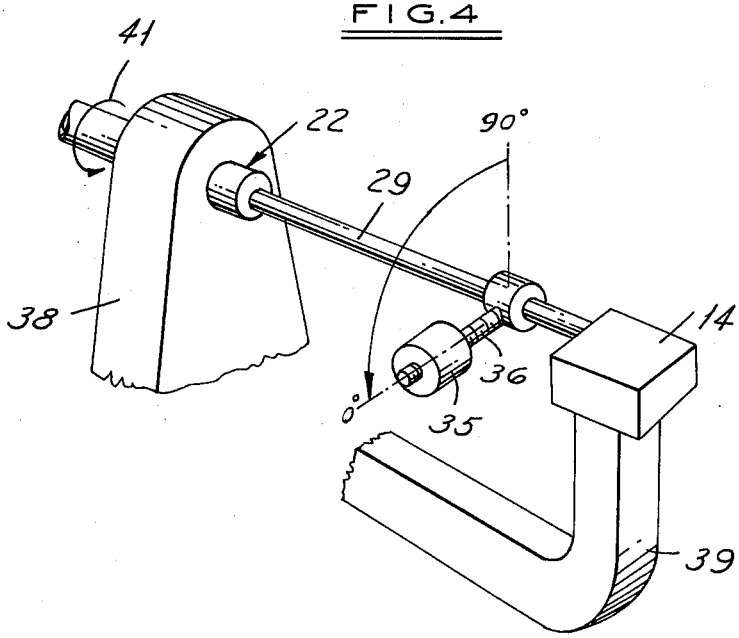
FIG. 4 is a concept sketch illustrating the basic elements of the error pointing compensating device.

FIG. 4 is a schematic view of the error compensating device embodying the present invention. In this view, the antenna main support structure is designated 38. The position indicator or angle indicating transducer 14 is shown supported on an arm 39 which is rigidly attached to the main support structure 38. The transfer shaft 22 is rotatable about the elevation axis upon the antenna being tilted by the antenna elevation drive mechanism (see 13 in FIG. 1). The transfer shaft extension 29 is coupled to the drive shaft (not visible) of the position indicator or angle transducer 14.

As the antenna swings or tilts from the zenith to the horizon, the transfer shaft 22 is rotated in the direction of the arrow 41. As the transfer shaft rotates, the eccentric mass or weight 35 also swings in the direction of the arrow 41 or from the 90° or zenith position toward the 0° or horizontal position as indicated. This causes the shaft 22 to be torsionally deflected by the eccentric mass in the direction of rotation thus adding to the angle of deflection recorded by the position indicator or angle transducer resulting from the rotation of the shaft 22 in response to pivoted or tilting movement of the antenna. The angle transducer 14 is thus caused to indicate the substantially true angle of elevation of the radio frequency beam thereby compensating for the fact that the reflector rotates further than the axis shaft 22 as the antenna travels from a zenith position (90°) to a horizon position (0°). The correction factor or torque applied to the shaft 22 is approximately proportional to the cosine of the angle of deviation of the radio frequency beam from the horizon or 0° line. At zenith typically no correction is needed as indicated by the fact that the cosine of 90° is zero. As horizon is approached the maximum correction is required as the cosine of 0° is unity. At this horizon or 0° angle, the maximum torsional deflection of the shaft 22 is obtained and is added to the position indicator drive shaft so that a first harmonic error compensation is achieved and a much more accurate reading of the angle of elevation of the radio frequency beam is obtained.

This holds true for any position between zenith and horizon and is applicable to an antenna that is being tilted downwardly from zenith to horizon or that is being tilted upwardly from horizon to zenith. In the latter case, the torsional deflection of the shaft 22 is being decreased as the threaded arm 36 carrying the eccentric mass swings upwardly from the horizon to the zenith. By the time the antenna reaches the zenith, the correction factor involved becomes substantially zero and the position indicator or angle transducer 14 reads the correct elevation of the antenna without any correction factor.

It is to be understood this invention is not limited to the exact construction illustrated and described in the above, but the various changes and modifications may be made without departing from the spirit and scope of the invention as defined by the following claims.

I claim:

1. A pointing error compensating device for compensating the error induced in a position indicator as a result of forces acting on a structure that is pivotable about an elevation axis, the error compensating device comprising a torque producing means having a moment arm in the form of an eccentric mass attached to a transfer shaft, the transfer shaft being interposed between the structure and a drive shaft of the position indicator and being rotatable in response to pivotable movement of the structure, the eccentric mass being constructed and arranged so that it applies a torque to the transfer shaft that is a function of the angular orientation of the structure about its elevation axis, the transfer shaft being deflected torsionally by the eccentric mass in an amount which is approximately equal and opposite to the error which otherwise would be transferred to the drive shaft of the position indicator.

2. A pointing error compensating device according to claim 1, in which:

the eccentric mass comprises a weight on a lever arm extending at a right angle to the axis of the transfer shaft.

3. A pointing error compensating device according to claim 2, in which:

the eccentric mass is adjustable longitudinally of the lever arm toward or away from the transfer shaft axis to optimize the torque producing effect.

4. A pointing error compensating device according to claim 1, in which:

the eccentric mass is adjustable toward or from the transfer shaft to adjust the effective moment arm.

5. A pointing error compensating device according to claim 1, in which:

the torque applied to the transfer shaft is proportional to the sine and cosine of the angular orientation.

6. A tracking antenna including a parabolic reflecting dish, mounting means supporting the tracking antenna for azimuth - elevation movements, the mounting means including pivot means providing an elevational axis about which the antenna is pivotable, an antenna elevation drive for pivoting the antenna about the elevation axis, and a position indicator for indicating the angle of elevation of the antenna, wherein the improvement comprises:

a shaft means coupled to the antenna and rotatable in response to pivotal movement of the latter about the elevation axis, coupling means connecting the shaft means to the drive shaft of the position indicator, and a moment arm extending from the shaft means at a right angle to the axis of rotation of the latter, the moment arm carrying a mass eccentrically of the axis of rotation, the eccentric mass being constructed and arranged so that it applies a deflection torque to the shaft means opposite to that applied by the antenna and that is a function of the angular orientation of the antenna about the elevation axis.

7. A tracking antenna according to claim 6, in which:

the eccentric mass torsionally deflects the shaft means an amount which is equal and opposite to the error which otherwise would be transferred to the position indicator drive shaft.

8. A tracking antenna according to claim 7, in which:

the eccentric mass is adjustable radially of the shaft means axis of rotation to permit adjustment of the torsional deflection effect on the shaft means.

9. A tracking antenna according to claim 8, in which:

the torque applied to the shaft means is proportional to the sine and cosine of the angular orientation of the antenna about the elevation axis.

10. A tracking antenna according to claim 6, in which:

the eccentric mass is adjustable radially of the shaft means axis of rotation to permit adjustment of the torsional deflection effect on the shaft means.

11. A tracking antenna according to claim 10, in which:

the torque applied to the shaft means is proportional to the sine and cosine of the angular orientation of the antenna about the elevation axis.

12. A tracking antenna including a radio frequency beam reflector, mounting means supporting the tracking antenna for azimuth - elevation movements, the mounting means including pivot means providing an elevation axis about which the antenna is tiltable to vary the angle of elevation thereof, antenna elevation drive means for pivoting the antenna about the elevation axis, and a position indicator for indicating the angle of elevation of the antenna and the pointing direction of the beam, the force of gravity acting on the reflector as the antenna is lowered from zenith elevation at 90° to horizontal elevation at 0° causing the reflector extremities to rotate further than the reflector structure at the pivot means whereby the effective pointing direction of the beam will vary from the angular orientation indicated by the position indicator with the minimum error occurring at zenith elevation and the maximum error occurring at horizon elevation, wherein the improvement comprises:

a pointing error compensating device interposed between the antenna and the position indicator, the error compensating device comprising a torque producing means having a moment arm in the form of an eccentric mass attached to a transfer shaft, the transfer shaft being coupled to the antenna for rotation in response to tilting movement of the latter and also being coupled to the drive shaft of the position indicator to rotate the drive shaft, the eccentric mass being constructed and arranged so that it applies a torque to the transfer shaft that is a function of the angular orientation of the antenna about the elevation axis, the transfer shaft being deflected torsionally by the eccentric mass in an amount approximately equal and opposite to the error input to the drive shaft.

13. A tracking antenna according to claim 12, in which:

the eccentric mass comprises a weight on a lever arm extending at a right angle to the axis of the transfer shaft.

14. A tracking antenna according to claim 13, in which:

the eccentric mass is adjustable longitudinally of the lever arm toward or away from the transfer shaft axis to adjust the torque producing effect.

15. A tracking antenna according to claim 12, in which:

the eccentric mass is adjustable toward or from the transfer shaft to adjust the effective moment arm.

16. A tracking antenna according to claim 12, in which:

the torque applied to the transfer shaft is proportional to the sine and cosine of the angular orientation.

* * * * *